US006425324B1

(12) United States Patent
Yamamoto

(10) Patent No.: US 6,425,324 B1
(45) Date of Patent: Jul. 30, 2002

(54) METHOD OF PRINTING ELECTRONIC IMAGES ON A PIECE OF COLORED CLOTH

(75) Inventor: Kaoru Yamamoto, Fukui (JP)

(73) Assignee: Yugen Kaisha Kowa Technoa, Fukui-Ken (JP)

( * ) Notice: Subject to any disclaimer, the term of this patent is extended or adjusted under 35 U.S.C. 154(b) by 0 days.

(21) Appl. No.: 09/539,619

(22) Filed: Mar. 31, 2000

(30) Foreign Application Priority Data

Apr. 2, 1999 (JP) ..... 11-095931

(51) Int. Cl.[7] ..... B41C 1/06
(52) U.S. Cl. ..... 101/34; 101/488; 156/277
(58) Field of Search ..... 101/33, 34, 41, 101/93, 146, 487, 488; 156/60, 230, 234, 235, 240, 277, 289, 384, 385, 386, 387

(56) References Cited

U.S. PATENT DOCUMENTS 5,324,378 A * 6/1994 Danon ..... 101/126
6,251,214 B1 * 6/2001 Ritchie ..... 156/327
6,258,194 B1 * 7/2001 Danon ..... 156/155

FOREIGN PATENT DOCUMENTS

| | | |
|---|---|---|
| JP | 3-48860 A | 3/1991 |
| JP | 09087980 | 3/1997 |
| JP | 10325087 | 12/1998 |

* cited by examiner

*Primary Examiner*—Ren Yan
(74) *Attorney, Agent, or Firm*—Rader, Fishman & Grauer PLLC

(57) ABSTRACT

Disclosed is an improved electronic image printing method, which uses a fourfold-laminated sheet B comprising a substrate, a mold-release layer, an adhesive layer and a milk white layer joined on top of each other in the order named, and a triple-laminated sheet A comprising a substrate, a mold-release layer and a resin layer joined on top of each other in the order named, thereby permitting a white letter or pattern to be printed on a piece of colored cloth. The adhesive layer may be selected to be appropriate for sticking fast to the material of which an article to be printed is made.

2 Claims, 4 Drawing Sheets

METHOD OF PRINTING ELECTRONIC IMAGES ON A PIECE OF COLORED CLOTH

BACKGROUND OF THE INVENTION

1. Field of the Invention

The present invention relates to an electronic image printing method in which: an electronic image formed with toner by an electronic image forming apparatus is transferred to a piece of transfer sheet; and the electronic image is transferred again to a T-shirt, a piece of synthetic leather, natural leather, plastic material, metal, glass, ceramic material, wood, paper and any other material.

2. Related Arts

As a recent tendency commercial products have been individualized to meet individual tastes, and accordingly it is required that a variety of commercial products be marketed in small lots. In order to suppress the rise of manufacturing cost it is of great concern that patterns be printed easily on T-shirts or other cloth products at a reduced cost. To meet such demand use is made of an electronic image forming apparatus to effect required printings on T-shirts or other cloth products by forming desired different images on pieces of thermal-transfer paper and by applying a relatively high pressure to laminations each of the thermal-transfer paper and the T-shirt at a relatively high temperature.

A desired image can be easily formed with the aid of a computer, and the so formed image is outputted from the electronic image forming apparatus to be transferred to a piece of thermal-transfer paper, as proposed in Japanese Patent 3-48860(A). According to the invention titled "method of forming toner image receptors" a desired toner image is put on a piece of transfer paper whose surface layer is adherent to toner; the transfer paper is laid on an image receptor with the toner image facing the image receptor; and the transfer paper is separated from the underlying image receptor while the transfer paper is heated above the toner softening temperature, thus leaving the toner image on the image receptor.

Another conventional art is disclosed in a Japanese Patent Application filed on Mar. 11, 1993, claiming a patent to the invention titled "Method of Transferring Pressure-Sensitive Images Instantaneously, Using Image Forming Carriers Provided by an Electronic Image Forming Apparatus". According to the claimed invention a substrate, an image carrier film bearing an image formed with toner, a cover coating and a pressure-sensitive coating are jointed on top of each other; the resulting lamination is put on an object to which the image is to be transferred, with the pressure-sensitive coating facing the object; the substrate is removed from the image carrier film; a rub-and-push is applied to the toner image via the overlying image carrier; and finally the image carrier is removed to leave the toner image on the object.

In transferring an electronic image from the transfer paper to a T-shirt or any other object undesired parts of the transfer paper such as the image-surrounding area are likely to be transferred to the T-shirt or cloth article. If an electronic image is transferred to a piece of colored cloth rather than a piece of white cloth, live color printing is almost impossible. Assuming that a rectangular piece of transfer paper has letters or patterns to be transferred to a piece of cloth, the parts of the background of the transfer paper which surround the letters or patterns are transferred to the piece of cloth, thus causing the printed images to be pleasing less in appearance than the originals.

In the hope of transferring letters or patterns exactly to a piece of cloth without lowering their live tones of colors the Japanese Patent 9-87980(A), published on Sep. 20, 1995 discloses "Electronic Image Printing Method and Thermal-Transfer Sheet". According to the Electronic Image Printing Method a sheet of lamination A comprising a substrate, a mold-release layer and a polyvinyl alcohol layer (PVA layer) or polyester resin layer jointed to top of each other, and another sheet of lamination B comprising a substrate, a mold-release layer, an adhesive layer and a color layer joined to top of each other are prepared; desired letters or patterns are formed on one of these laminations A and B with toner; these lamination A and B are laid on each other to sandwich the toner images therebetween to be pressed at an elevated temperature; and the laminations A and B are so separated from each other as to leave the color layer and overlying adhesive layer on the lamination A; the remaining composite lamination is applied to a T-shirt to remove the substrate-and-mold-release layer combination; and the remaining composite lamination is pressed at an elevated temperature; and finally the polyvinyl alcohol layer (PVA layer) or polyester resin layer is removed to leave the toner images, which are applied to the T-shirt via the color-and-adhesive composite lamination.

Presence of the color layer under the desired letters or patterns formed with toner prevents effectively the colors of the desired images from being adversely effected by the color of the T-shirt, thus providing the live colored prints on the T-shirt no matter what color the T-shirt may be of. The Electronic Image Printing Method, however, cannot be used in printing white letters or patterns on a piece of colored cloth because no white toner is available. Letters and patterns are often white or partly white, and such letters and patterns cannot be printed. Accordingly the kinds of letters and patterns to be printed are limited significantly.

According to the teaching of Japanese Patent 10-325087 (A), an electronic image is transferred to a thick-colored thermal-transfer sheet, and the electronic image is cut out with a cutter to be transferred to an object. In printing desired white letters these letters are processed by a computer to provide data which represent their contours; the white letters are cut away automatically from the first thick-colored thermal-transfer sheet to be heat-pressed and transferred to another thermal-transfer sheet having a release layer jointed to its top; and finally the white letters are thermal-transferred from the second thermal-transfer sheet to a thick-colored object.

It is, however, difficult to cut a desired letter or pattern exactly from the thick-colored transfer sheet manually, and five-millimeter or smaller letters or patterns can be hardly cut out. Apparatus for computer-aided cutting, however, is inhibitively expensive, and therefore, the demand for printing at a low cost cannot be met.

SUMMARY OF THE INVENTION

In view of the above one object of the present invention is to provide an electronic image printing method permitting the quick transfer of electronic images from thick colored transfer sheets to desired thick-colored articles at a reduced cost, not requiring the manual or computer-aided cutting-out of desired images no matter what size the image may have, small or large.

The printing of white or milk white letters or patterns is permitted on pieces of colored cloth. Also, the printing of colored letters or patterns on white or milk white base areas, which are printed on pieces of colored cloth, is permitted.

First, a desired letter or pattern is formed on a piece of copying paper to provide a negative image of the desired letter or pattern with toner.

A piece of laminated sheet B comprising a substrate, a mold-release layer, an adhesive layer and a white (milk white) layer joined on top of each other is prepared.

The piece of copying paper is laid on the piece of laminated sheet B to be thermal-pressed together.

Removal of the copying paper from the underlying laminated sheet B permits the area of milk white layer-and-adhesive layer combination corresponding to the negative image to be taken apart from the underlying laminated sheet B, thus leaving the remaining area of milk white layer-and-adhesive layer combination corresponding to the positive image of the desired letter or pattern.

A piece of laminated sheet A comprising a substrate, a mold-release layer and a resin layer joined on top of each other is prepared, and the piece of laminated sheet A is laid on the so modified laminated sheet B to be pressed at an elevated temperature, thus allowing the positive image of milk white layer-and-adhesive layer combination to be transferred to the laminated sheet A.

The laminated sheet A having the positive image under is applied to a piece of colored cloth with the adhesive layer facing the colored cloth to be pressed together at an elevated temperature. Finally the laminated sheet A is removed from the piece of colored cloth, thus providing the piece of colored cloth having the desired white letter or pattern printed thereon.

Also, it is possible to print colored letters or patterns within a milk white base area, which is printed on a piece of colored cloth. The colored letters or patterns are printed on a piece of laminated sheet A with a color copier, a color laser printer or an ink-jet printer. On the other hand, a negative image of base is formed on a piece of copying paper with toner, and the copying paper is laid on a piece of laminated sheet B to be pressed at an elevated temperature. Removal of the copying paper leaves the positive image of the base on the laminated sheet B, which positive image of the base is composed of the milk white layer-and-adhesive layer. The laminated sheet A having the colored letters or patterns printed on its top is laid on the so modified laminated sheet B to be pressed at an elevated temperature. Removal of the laminated sheet A causes the base area of milk white layer-and-adhesive layer to leave the mold-release layer of the laminated sheet B. The laminated sheet A whose top has the colored letters or patterns in the base area of milk white-and-adhesive composite lamination is laid on a piece of colored cloth with the adhesive layer facing the colored cloth to be pressed together at an elevated temperature, thus allowing the colored letters or patterns along with the milk white base area to be transferred from the underlying mold-release layer to the piece of colored cloth. Thus, the piece of colored cloth having the colored letters or patterns printed on the milk white base area.

Alternatively a similar piece of colored cloth having colored letters or patterns printed on its milk white base area may be provided by color-printing the letters or patterns on the milk white layer of the laminated sheet B, although the transferring steps in the proceeding described above need be somewhat changed in the order.

Temperatures, pressures and lengths of time involved for pressing different composite laminations at elevated temperatures in the course of image-transfer are dependent on what kinds of material such laminated sheets are made.

Other objects and advantages of the present invention will be understood from the following description of preferred embodiments of the present invention, which are shown in accompanying drawings.

DETAILED DESCRIPTION OF PREFERRED EMBODIMENT

Figure 1:
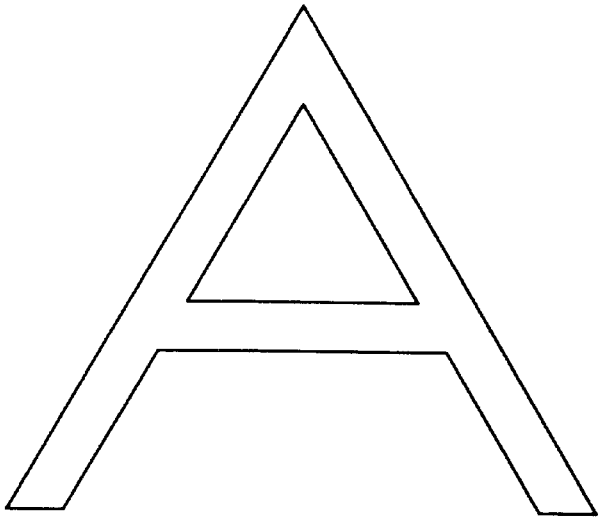
FIG. 1 shows a piece of colored cloth having the letter, "A" printed thereon.
Figure 2:
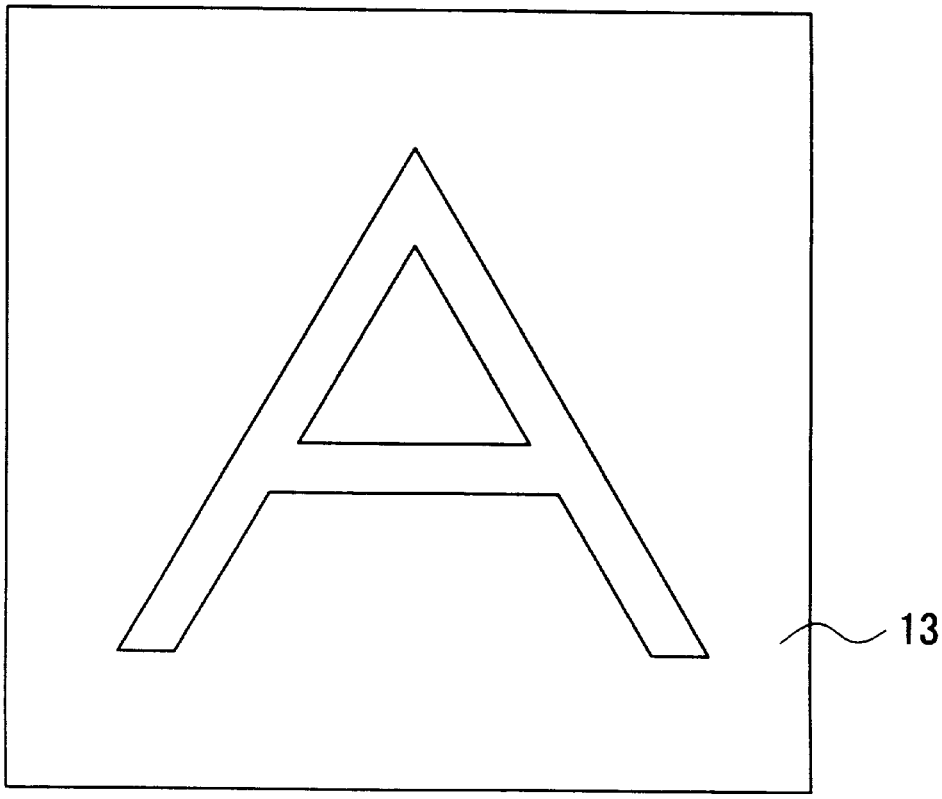
FIG. 2 shows a piece of colored cloth having the letter, "A" printed in its white base area.

FIG. 1 shows a black T-shirt having the letter "A" printed thereon, and FIG. 2 shows a black T-shirt having the colored letter "A" printed in its white square base area 13.

EXAMPLE 1

Referring to FIGS. 3*a* to 3*f*, the manner in which the T-shirt of FIG. 1 can be provided is described. First, a copying apparatus is used to print the letter "A" on a piece of copying paper 1, thus forming a negative image of "A" with toner 3. As seen from FIG. 3*a*, toner 3 is applied to the whole area of the copying paper 1 other than the toner-free part forming the letter, "A". The piece of copying paper 1 is laid on a piece of laminated sheet B 2*a*, and a pressure of approximately 320 grams per square centimeter is applied to the copying paper-and-laminated sheet combination at the temperature of 130 degrees C. for approximately 30 seconds.

The piece of laminated sheet B 2*a* comprises a substrate film 4, a mold-release layer 5 of silicone or any other appropriate material (SHINETU SILICONE KS776L), an adhesive layer 6 ("CLISBON" 4407 commercially available from DAINIPPON K.K.) and a milk-white layer 7 (mixture of "PATERACOLE" IJ-170 commercially available from DAINIPPON INK K.K. and TI-PURE R-900 commercially available from Du Pont) joined on top of each other in the order named.

Figure 3A:
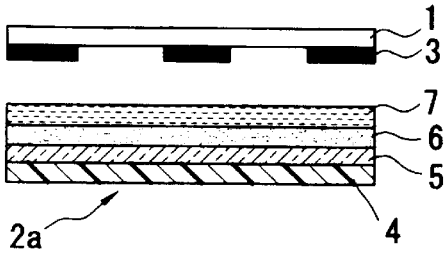
FIGS. 3*a* to 3*f* illustrate how the letter, "A" can be printed on a piece of colored cloth.
Figure 3B:
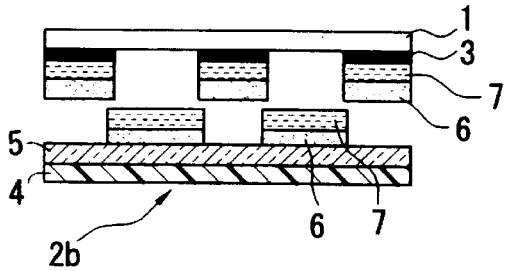

The piece of copying paper 1 is removed to take the selected regions of the milk white layer 7 and adhesive layer 6 apart from the laminated sheet "B", as shown in FIG. 3*b*. The selected regions of milk white layer-and-adhesive lamination have the same shape as the negative image of "A", thus leaving behind on the substrate-and-mold-release layer combination of the laminated sheet B the remaining regions of milk white layer 7 and underlying adhesive layer 6, which have the same shape as the positive image of "A" to be printed.

Figure 3C:
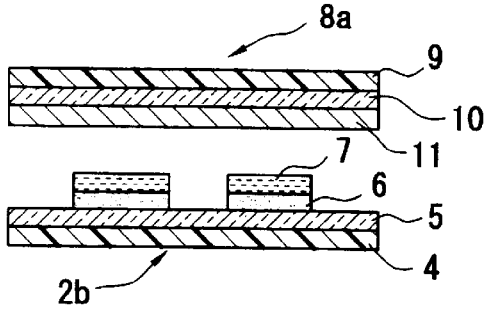

As seen from FIG. 3*c*, the so modified laminated sheet B 2*b* is laid on a piece of triple-laminated sheet A 8*a*, which comprises a substrate 9, a mold-release layer 10 and a resin layer 11 (for example, made of a mixture of "PATERACOLE" IJ-170 commercially available from DAINIPPON INK K.K. and COVER COAT RESIN LO-300 commercially available from GOKAGAKU-SHA) joined on top of each other in the order named.

A pressure of approximately 320 grams per square centimeter is applied to the so modified laminated sheet B2*b*-and-laminated sheet A 8*a* combination at the temperature of approximately 130 degrees C. for approximately 30 seconds.

Figure 3D:
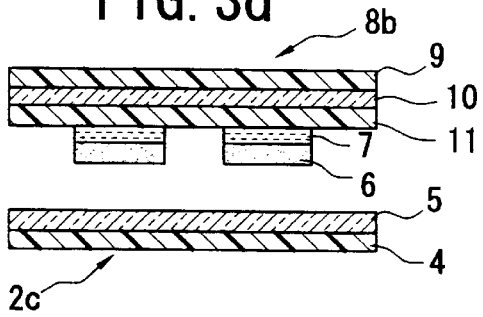

Then, the triple-laminated sheet A 8*b* is removed to be accompanied by the regions of milk white layer 7 and adhesive layer 6 of the same shape as the letter, "A" to be printed, as seen from FIG. 3*d*. Thus, the remaining laminated sheet "B" 2*c* comprises the substrate 4 and the overlying mold-release layer 5.

Figure 3E:
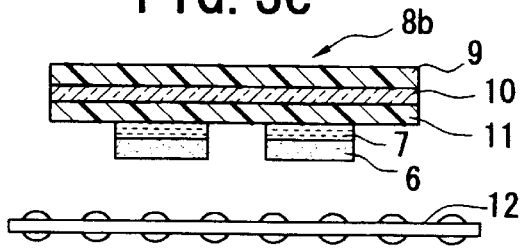
Figure 3F:
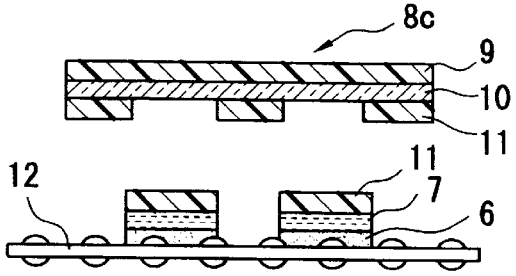

The laminated sheet A 8*b* having the regions of milk white layer 7 and overlying adhesive layer 6 shaped in the form of the letter "A" to be printed is put on a black T-shirt 12, as seen from FIG. 3*e*.

A pressure of approximately 320 grams per square centimeter is applied to the so modified laminated sheet A-and-black T-shirt combination at the temperature of approximately 130 degrees C. for approximately 15 seconds. Then, the so modified laminated sheet A is removed to leave the black T-shirt having the milk white letter, "A" printed on its black background. As seen from FIG. 3*f*, the letter, "A" of adhesive layer-and-milk white layer lamination has a resin coating 11 applied to its milk white layer 7.

EXAMPLE 2

Referring to FIG. 4, the manner in which the T-shirt of FIG. 2 can be provided is described.

Figure 4A:
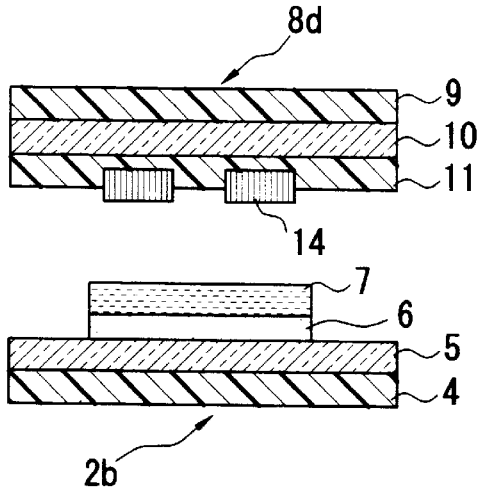
FIGS. 4*a* to 4*d* illustrate how the letter, "A" can be printed in the white background area, which is printed on a piece of colored cloth.
Figure 4B:
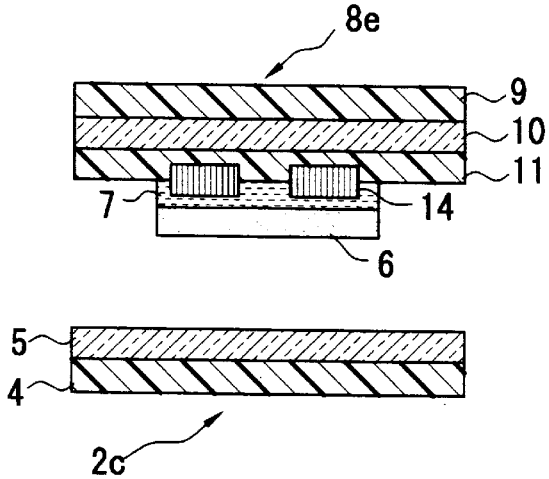
Figure 4C:
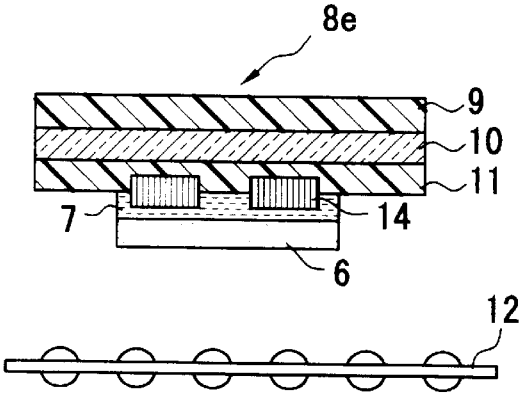
Figure 4D:
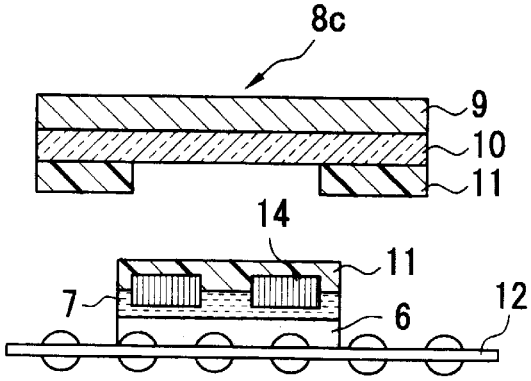

As seen from FIG. 4*a*, a piece of triple-laminated sheet A 8*d* comprises a substrate 9, a mold-release layer 10 and a resin layer 11 joined on top of each other, and the letter, "A" 14 is color-printed on the triple-laminated sheet A 8*d* by using a color-copying machine, such as A color 620 manufactured by Fuji Xerox. On the other hand, a negative image of square base area is formed on a piece of copying paper, (not shown) with toner, and the copying paper is laid on a piece of fourfold-laminated sheet B 2*b*, which comprises a substrate 4, a mold-release layer 5, an adhesive layer 6 and a milk-white layer 7 joined on top of each other in the order named. A pressure of approximately 320 grams per square centimeter is applied to the copying paper-and-fourfold-laminated sheet combination at the temperature of approximately 130 degrees C. for approximately 30 seconds. Removal of the copying paper from the underlying fourfold-lamination allows the toner to carry the selected area of milk white-and-adhesive lamination surrounding the one corresponding to the base area of the fourfold-lamination, thus leaving the base area of milk white-and-adhesive lamination on the double-lamination of mold-release layer-and-substrate of the laminated sheet B. The so modified laminated sheet B 2*b* is combined with the triple-laminated sheet A 8*d* having the letter "A" color-copied thereon, as seen from FIG. 4*a*.

A pressure of approximately 320 grams per square centimeter is applied to the so combined laminated sheets A 8*d* and B 2*b* at the temperature of approximately 130 degrees C. for approximately 30 seconds. Then, the laminated sheet is removed to carry the base region of milk white layer 7 and underlying adhesive layer 6 from the modified laminated sheet B 2*b*, thus leaving the double lamination 2*c* of the substrate 4 and the mold-release layer 5, as seen from FIG. 4*b*.

The laminated sheet A thus provided is put on a black T-shirt 12, and a pressure of approximately 320 grams per square centimeter is applied to the so provided lamination-and-black T-shirt combination at the temperature of approximately 130 degrees C. for approximately 15 seconds. Finally the so modified lamination 8*e* is removed to leave the black T-shirt having the colored letter, "A" and the underlying milk white base area 7 stuck fast to its black background. Specifically, the colored letter, "A" is formed on the base area of milk white layer 7-and-adhesive layer 6 in the T-shirt 12, and the letter "A" formed with color toner is covered with resin layer 11 for protection.

EXAMPLE 3

Referring to FIG. 5, an alternative manner in which the T-shirt of FIG. 2 can be provided is described.

Figure 5A:
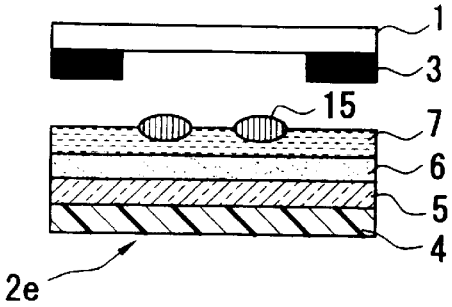
FIGS. 5*a* to 5*f* illustrate how the colored letter, "A" can be printed in the white background area, which is printed on a piece of colored cloth.
Figure 5B:
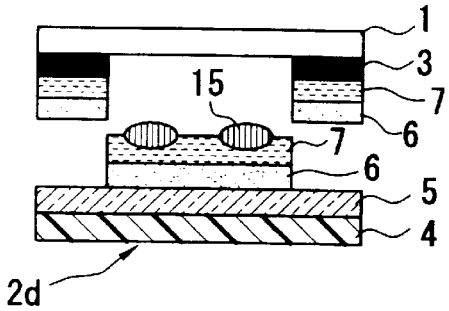

As seen from FIG. 5*a*, a piece of fourfold-laminated sheet B 2*e* comprises a substrate 4, a mold-release layer 5, an adhesive layer 6 and a milk white layer 7 joined on top of each other, and the letter, "A" 15 is color-printed by using a color ink-jet printer, such as an HP DESKJET 815 produced by Hewlett-Packard. On the other hand, a negative image of square base area is formed on a piece of copying paper 1 with toner 3, so that the toner-free area may define the square base.

The copying paper 1 is laid on the laminated sheet B 2*e* to be pressed together at a raised temperature. Removal of the copying paper 1 causes the tray 3 to carry the surrounding area around the base area of the fourfold-lamination, thus leaving the base area of milk white-and-adhesive layer 7 and 8 on the double-lamination of mold-release layer-and-substrate 5 and 4 of the laminated sheet B 2*d*, the milk white base area having the letter, "A" color-printed on its top, as seen from FIG. 5*b*.

Figure 5C:
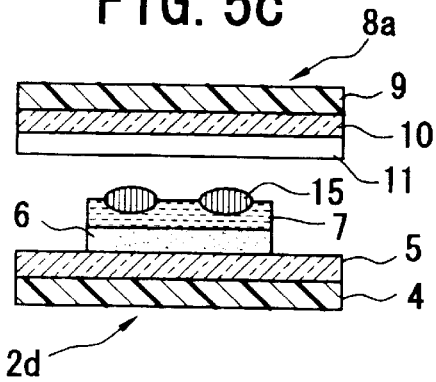
Figure 5D:
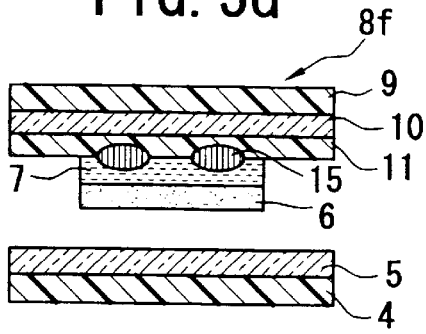
Figure 5E:
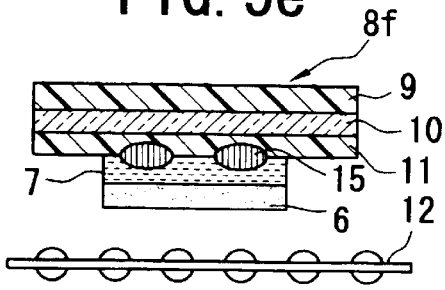
Figure 5F:
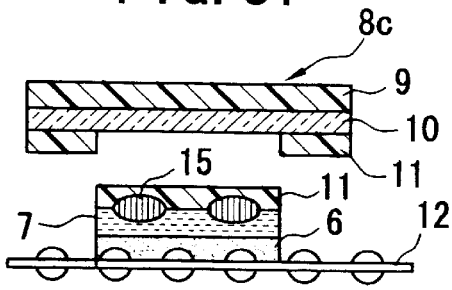

As seen from FIG. 5*c*, the laminated sheet "B" 2*d* is laid on a piece of triple-laminated sheet A 8*a*, which comprises a substrate 9, a mold-release layer 10 and a resin layer 11 (made of a mixture of "PATERACOLE" IJ-2 commercially available from DAINIPPON INK K.K. and "COVER COAT RESIN" LO-300 commercially available from GOKAGAKU-SHA) jointed on top of each other in the order named. A pressure of approximately 320 grams per square centimeter is applied to the so combined laminated sheets A 8*a* and B 2*d* at the temperature of approximately 130 degrees C. for approximately 30 seconds. Then, the laminated sheet A 8*a* is removed to carry the base region of milk white-and-adhesive lamination from the odified laminated sheet B 2*d*, thus leaving the double lamination 2*c* of substrate 4 and mold-release layer 5, as seen from FIG. 5*d*.

The so provided laminated sheet A 8*f* is put on a black T-shirt 12, and a pressure of approximately 320 grams per square centimeter is applied to the combination at the temperature of approximately 130 degrees C. for approximately 15 seconds. Finally the overlying lamination 8*f* is removed to provide a black T-shirt having the colored letter, "A" and the underlying milk white base area printed on its black background, as seen from FIG. 5*f*.Specifically, the colored letter, "A" is formed on the base area of milk white layer 7-and-underlying adhesive layer 6 in the T-shirt 12, and the letter, "A" is covered with resin 11 for protection.

As may be understood from the above, the electronic image printing method according to the present invention uses a fourfold-laminated sheet B comprising a substrate, a mold-release layer, an adhesive layer and a milk white layer joined on top of each other in the order named, and a triple-laminated sheet A comprising a substrate, a mold-release layer and a resin layer joined on top of each other in the order named, thereby permitting a white letter or pattern to be printed on a piece of colored cloth. The adhesive layer may be selected to be appropriate for sticking to the material of which an article to be printed is made.

What is claimed is:

1. Method of printing at least one electronic image on a piece of black or colored cloth comprising the steps of:

a) copying at least one letter, character and/or at least one pattern on a piece of copying paper to form a negative image with toner;

b) putting the piece of copying paper on a piece of laminated sheet B comprising a substrate, a mold-release layer, an adhesive layer and a milk-white layer joined on top of each other in the order named;

c) applying a relatively high pressure to the copying paper-and-laminated sheet combination at a relatively high temperature for a predetermined length of time;

d) removing the piece of copying paper along with selected regions of milk white layer and underlying adhesive layer, which selected regions have the same shape as the negative image formed with toner, thus leaving behind on the substrate-and-mold-release layer combination of the laminated sheet B the remaining regions of milk white layer and underlying adhesive layer, which remaining regions have the same shape as the letter, character and/or pattern to be printed;

e) putting on the so modified laminated sheet B a piece of laminated sheet A comprising a substrate, a mold-release layer and a resin layer joined on top of each other in the order named;

f) applying a relatively high pressure to the so modified laminated sheet B-and-laminated sheet A combination at a relatively high temperature for a predetermined length of time;

g) removing the piece of laminated sheet A along with the regions of milk white layer and underlying adhesive layer of the same shape as the letter, character and/or pattern to be printed;

h) putting on the piece of black or colored cloth the piece of laminated sheet A having the regions of milk white layer and underlying adhesive layer shaped in the form of the letter, character and/or pattern to be printed;

i) applying a relatively high pressure to the so modified laminated sheet A-and-colored cloth combination at a relatively high temperature for a predetermined length of time; and j) removing the so modified laminated sheet A to leave the piece of black or colored cloth having the milk white letter, character and/or pattern printed on its black or colored background.

2. Method of printing at least one electronic image according to claim 1, wherein a pressure of approximately 320 grams per square centimeter is applied to the copying paper-and-laminated sheet combination at the temperature of approximately 130 degrees C. for approximately 30 seconds in the step (c);

a pressure of approximately 320 grams per square centimeter is applied to the modified laminated sheet B-and-laminated sheet A combination at the temperature of approximately 130 degrees C. for approximately 30 seconds in the step (f); and a pressure of approximately 320 grams per square centimeter to the modified laminated sheet A-and-colored cloth combination at the temperature of approximately 130 degrees C. for approximately 15 seconds in the step (i).

* * * * *